United States Patent [19]

Hammond

[11] 4,028,804

[45] June 14, 1977

[54] CHAIN SAW WITH THROTTLE CONTROL

[75] Inventor: Walter J. Hammond, Lakewood, Calif.

[73] Assignee: McCulloch Corporation, Los Angeles, Calif.

[22] Filed: Apr. 19, 1976

[21] Appl. No.: 678,133

[52] U.S. Cl. ..... 30/382; 123/198 D

[51] Int. Cl.[2] ..... B27B 17/02

[58] Field of Search ..... 123/198 D; 30/166 R, 30/286, 382, 383, 384, 381; 180/19 H

[56] References Cited

UNITED STATES PATENTS

| | | | |
|---|---|---|---|
| 2,610,657 | 9/1952 | Kiekhaefer | 30/383 |
| 3,361,165 | 1/1968 | Irgens | 30/381 |

FOREIGN PATENTS OR APPLICATIONS

| | | | |
|---|---|---|---|
| 942,591 | 5/1956 | Germany | 30/381 |

*Primary Examiner*—Al Lawrence Smith
*Assistant Examiner*—J. C. Peters

[57] ABSTRACT

Disclosed is a safety interlock system for restraining certain kinds of movement of a chain saw throttle actuator. The system includes a stop member having an abutment portion for engaging the throttle actuator and a release portion projecting from a surface of the chain saw handgrip in position to be engaged by the hand of an operator gripping the handgrip. The stop member is rotatably mounted on the saw such that the movement of the stop member, as the release portion is depressed into a recess of the handgrip by the operator's hand, causes the abutment portion to swing away from interfering contact with the throttle actuator. Biasing means for the stop member maintain it in an orientation that prevents movement of the throttle actuator until the biasing force is overcome by the pressure of an operator's hand.

The stop member can also include a lever portion and a hook portion, the latter engagable with a mating hook on the throttle actuator when that actuator is in an intermediate, or fast idle, position. Manipulation of the stop member, employing the lever portion, can cause engagement of the mating hooks, thereby enabling retention of the throttle actuator in a fast idle orientation.

1 Claim, 10 Drawing Figures

CHAIN SAW WITH THROTTLE CONTROL

BACKGROUND OF THE INVENTION

The present invention relates to improvements in chain saws. In particular, the invention relates to a safety interlock arrangement for the chain saw throttle actuator to prevent, in certain circumstances, movement of the actuator, under the influences of the actuator biasing systems and pressure exerted on the actuator by an operator of the chain saw.

Although various other chain saw safety devices have been proposed, previous arrangements have had different structures and/or different functions. Thus, for example, Irgens, U.S. Pat. No. 3,361,165 discloses a lever on the forward handle bar of a chain saw that is operable, through intermediate flexible cables, to control the operation of a safety clutch (which prevents operation of the chain saw when it is not properly held by the front handlebar) and of the throttle. This throttle control is thus a "two handed" system requiring a somewhat elaborate, and potentially cumbersome, linkage. In Johannson, U.S. Pat. No. 3,785,465, a safety device causes disengagement of a driving portion of a chain saw clutch when a safety grip is released. The safety grip is provided on the chain saw handgrip, but operates only by electrical connection with an electromagnet and, additionally, operates only upon a chain saw clutch rather than directly upon the throttle actuator.

Of course, throttle control devices, and other safety mechanisms, have been known in other fields for some time. The problems being solved in those fields, as well as the structures used to solve them are, of course, typically quite different from the environment of the present invention. Illustrative of such situations are Thorner, U.S. Pat. Nos. 2,917,142 and 3,168,933, each of which is directed to a throttle control mechanism for use in a motor vehicle. In the firearms category, mention can be made of Randall, U.S. Pat. No. 1,509,257 which discloses an arrangement preventing depression of the weapon's trigger unless the weapon is properly gripped by the user. While the illustrative embodiment in the Randall patent is that of a rifle, it is well known that arrangements have been provided on pistols.

OBJECTS AND SUMMARY OF THE INVENTION

It is therefore a general object of the present invention to provide a simple, effective, and substantially foolproof arrangement for preventing accidental acceleration of a chain saw engine from a predetermined slow idle condition.

It is another object of the present invention to provide such an arrangement that is relatively simple to manufacture and install in a chain saw, that requires no major redesigning of present chain saw structures and components, and that works substantially automatically without the necessity of operator instruction.

A preferred form of the present invention intended to accomplish at least some of the foregoing objects, involves the use of a stop member pivotally mounted internally on the chain saw handgrip. The stop member has an abutment portion that prevents movement of the chain saw throttle actuator when the stop member is in the first position and a release portion protruding from the handgrip means in that first position. Biasing means urge the stop member toward that first position, but can be overcome by an operator's hand gripping the chain saw handgrip. Pressure from the operator's hand depresses the release portion and simultaneously the abutment portion is swung away from its position hindering movement of the throttle actuator. In a preferred embodiment, the stop member and the throttle actuator each include hook means that can be engaged with each other to maintain the throttle actuator at an intermediate throttle actuator position, thereby enabling a fast idle throttle actuator position to be maintained without the necessity of constant pressure on the throttle actuator by the operator.

THE DRAWINGS

Other objects, features and advantages of the invention will become apparent from the following detailed description of the invention with reference to the accompanying drawings in which.

Figure 1:
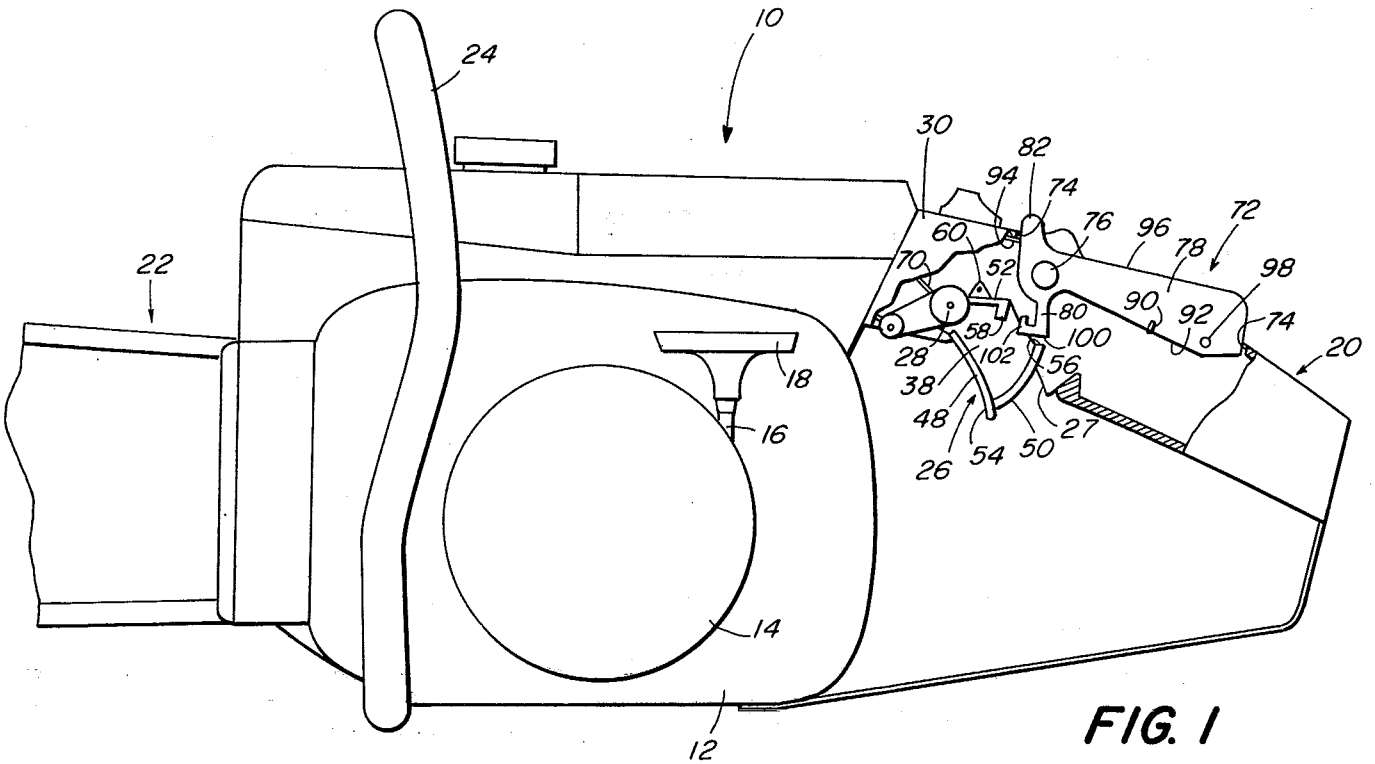
FIG. 1 is a partially broken away side elevation of a chain saw incorporating features according to the present invention.
Figure 2:
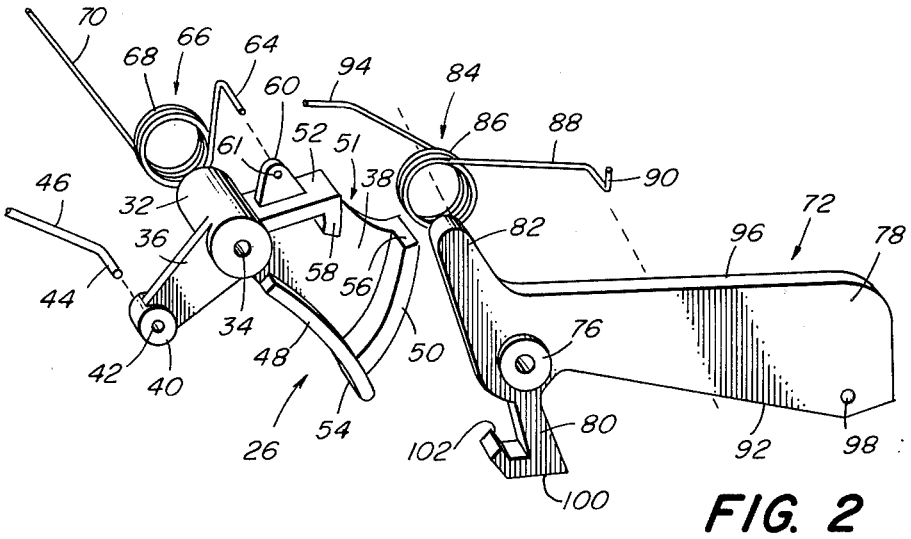
FIG. 2 is an exploded view of a safety interlock system of the chain saw in FIG. 1.
Figure 3A:
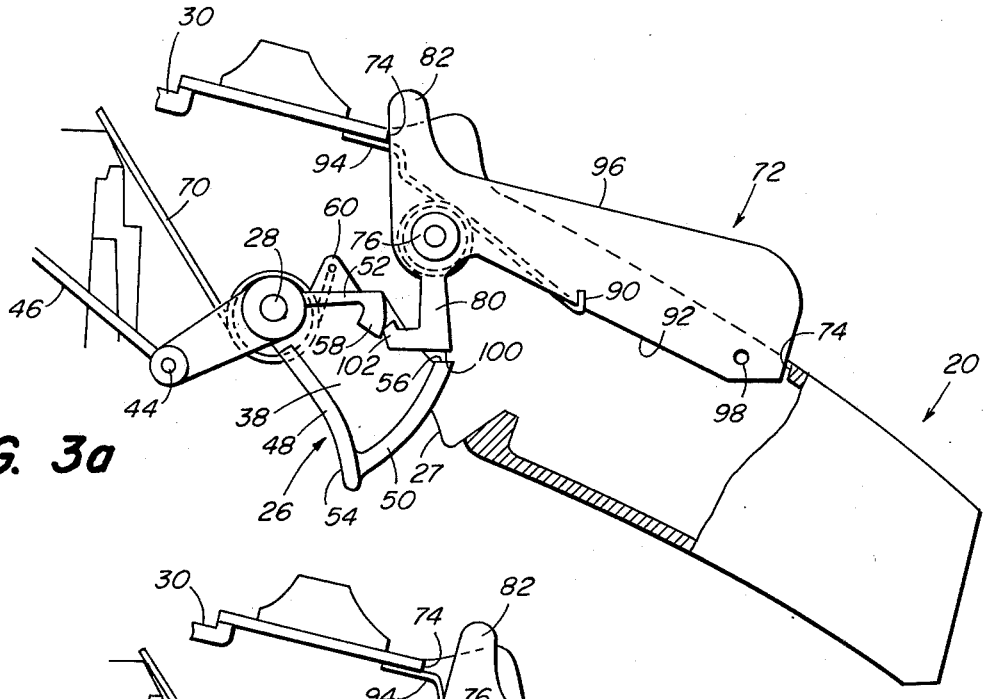
Figure 3B:
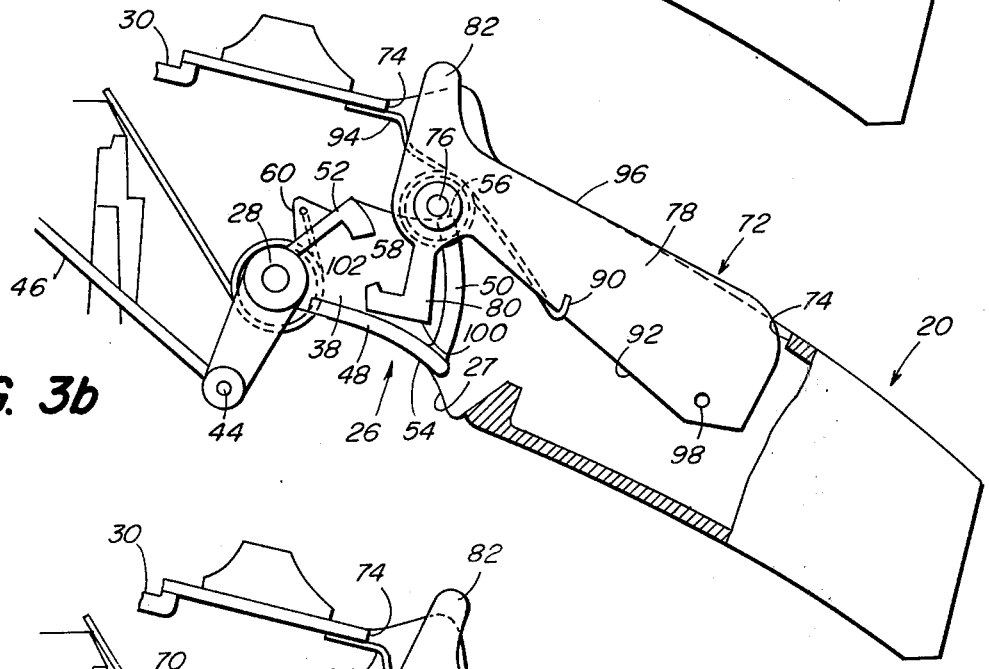
Figure 3C:
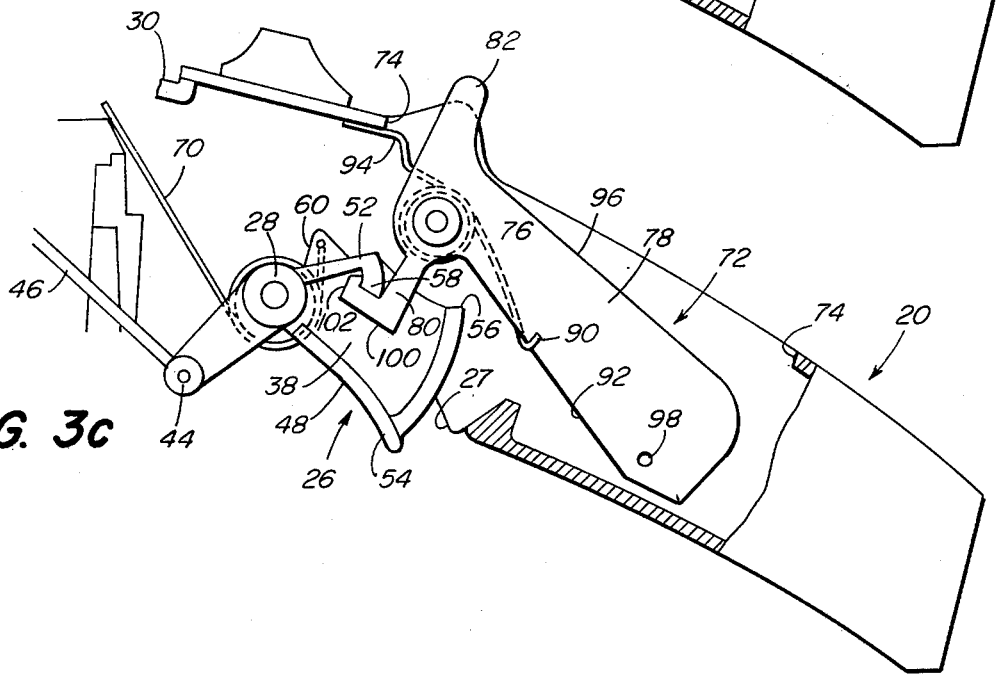

FIGS. 3*a*, 3*b*, and 3*c* comprise schematic illustrations showing the interaction of components of the safety interlock system of FIG. 2; and FIGS. 4, 5, and 6*a*-6*c* are views analogous to, respectively, FIGS. 1, 2, and 3*a*-3*c* and illustrate another throttle safety interlock arrangement within the scope of the present invention.

DETAILED DESCRIPTION OF ILLUSTRATED EMBODIMENTS

Referring first to FIG. 1, there is shown a portion of a chain saw 10 that includes a housing 12 for an internally mounted chain saw engine means (not shown) and that supports a protective cover 14 enclosing a pulley (not shown) linked to the engine means and also to a cord 16 having a handle 18 at its free end. The pulley, cord 16, and handle 18 are elements of a conventional manual starting system for the chain saw engine means. Chain saw hand grip means 20, preferably formed integrally with at least a portion of the housing 12, project from one side of the housing and chain saw cutter chain means 22 project from the other side of the housing 12. A wrap-around handle bar 24 is secured to the housing 12 intermediate the hand grip means 20 and the chain means 22. The handle bar 24 and the hand grip means 20 are gripped by the saw operator's hand during use of the chain saw.

Referring more particularly to the hand grip means 20, it will be seen that throttle actuator means 26 are supported partially-recessed in a slot 27 in a lower surface of the hand grip means housing 30 for pivotal movement about a pivot pin 28. As best seen in FIG. 2, the throttle actuator means 26 are preferably fromed as a unitary molded member including a hub 32 having an opening 34 therethrough for receiving the pivot pin 28, and generally planar webs 36 and 38 projecting radially from the hub. A second hub 40 at the opposite end of web 36 includes an opening 42 for receiving a toe portion 44 of a linkage 46 connected in a conventional fashion to a carburetor (not shown) of the chain saw engine means. As will be evident to those skilled in the art, rotation of the actuator means 26 about the pivotal axis 28 will cause movement of the linkage 46 that is employed in a conventional manner, to cause engine acceleration.

The web 38 of the actuator means 26 has a series of integral rib means 48, 50, and 52 projecting perpendicularly from various edges of the web 38. The rib means do not totally enclose the edges of the web 38, however, a gap 51 being provided between rib means 50 and 52. Important features of the rib means, the significance of which is discussed further below, are the front surface 54 of rib means 48, and end surface 56 of rib means 50, and a hook portion 58 of rib means 52 curving inwardly with respect to the web 38. The gap in the rib means is located between the hook portion 58 of the rib means 52 and the end surface 56 of rib means 50. A lobe 60 of the web 38 projects above the rib means 52 and includes a recess 61 for receiving a tip portion 64 of a biasing torsion spring 66. The spring 66 also includes a central coil 68 sized to be disposed around the hub 32 and a projecting leg 70 positioned to engage a surface of the chain saw housing in the assembled device. The spring means 66 serve to bias the throttle actuator means 26 in a clockwise direction as viewed in FIGS. 1–3.

As is evident from FIGS. 1 and 2, the actuator means 26 are positioned with respect to the handgrip means housing 30 such that most of the actuator means 26 are recessed within that housing 30, but the rib means 48, and an adjacent portion of the rib means 50, are exposed. This positions the front face 54 of the rib means 48 in a suitable location to be engaged by a finger of the operator's hand, gripping means 20, to move the actuator 26 in a counter-clockwise direction against the biasing force of spring 66.

A throttle actuator stop means 72 is supported on the handgrip means 20 for movement in a slot 74 (see FIG. 1) provided in the upper surface of the hand grip means housing 30. The stop means 72 are supported for rotational motion about a shaft 76 disposed internally of the housing 30 and secured thereto. The stop means 72 include a release portion 78, a throttle actuator abutment portion 80, and a lever portion 82. Torsion spring means 84 (see FIG. 2) are provided for biasing the stop means 72 in a counter-clockwise direction as viewed in FIGS. 1–2. The spring means 84 include a central coil 86 sized to be disposed around the shaft 76, a first leg 88 having a hooked end portion 90 for engaging a lower edge 92 of the release portion 78 and a second leg 94 shaped to engage a fixed inside surface of the hand grip means housing 30.

The release portion 78 of the stop means 72 includes a generally planar body having an upper edge 96 disposed to be exterior of the hand grip means housing 30 in certain orientations of the stop means 72. A stud 98 projecting from one face of the release portion 78 engages the hand grip means housing 30 adjacent the slot 74 to define the rest position of the stop means 72 under the influence of the biasing spring means 84. As is evident form FIG. 1, in that rest position of the stop means 72, a segment of the release portion 78, including the upper edge 96, will be exterior of the housing 30. In that same rest position, a lower surface 100 of the abutment portion 80 is disposed closely adjacent the end surface 56 of rib means 50 on the throttle actuator 26 and in a position to engage that end face 56 upon counter-clockwise rotation of the actuator 26 from its rest (i.e., slow idle) position shown in FIG. 1. The abutment portion 80 also includes hook means 102 disposed to be positioned within the gap between rib means 50 and 52.

The lever portion 82 of the stop means 72 also projects from the slot 74 at a location suitable to be engaged by a digit of the operator's hand. In particular, the lever portion 82 is positioned, as is evident from FIG. 1, to be engagable by the operator's thumb when the operator's index finger is engaged with the front face 54 of throttle actuator rib means 48.

FIGS. *3a-3c* illustrate the three operative positions of the stop member 72 and associated positions of the throttle actuator means 26. The operator of the safety interlock system may now be described with reference to FIGS. *3a-3b.* With the stop means 72 in the rest position of FIG. *3a,* under the influence of the biasing spring 84, the throttle actuator means 26 is prevented from moving substantially from rest position even if accidently bumped, because of the positioning of surface 100 of abutment portion 80 to intercept the rib means 50 of the actuator 26. In conventional chain saw construction, the drive means for establishing a driving connection between the engine means and the cutter chain means include a centrifugal friction clutch designed to be engaged only at throttle positions greater than the slow idle position that corresponds to the actuator's rest position. The chain means will thus remain stationary, and therefore not dangerous even if the actuator means 26 is accidently bumped, or otherwise experience a force tending to rotate the means 26 from the slow idle position.

When the chain saw hand grip means 20 are properly gripped by an operator, however, the pressure of the operator's hand against the edge 96 will cause clockwise rotation of the stop means 72 to the operating position indicated at FIG. *3b.* This rotation of the stop means 72 causes the surface 100 of abutment portion 80 to swing out of the way of the rib means 50 and 52 of the actuator 26 thereby causing an overlap between the stop means 72 and the actuator means 26. This contributes to a compact arrangement of the parts and facilitates an additional feature of the safety interlock system.

That additional feature is illustrated by the stop means 72 and actuated means 26 in their positions indicated at FIG. *3c.* By employing thumb pressure on the lever portion 82, the stop means can be rotated in a further clockwise direction, against the influence of its biasing spring 84, than the position indicated at FIG. *3b,* in which the edge 96 essentially flush with the housing 30 of the hand grip means. That additional rotation places the hook portion 102 of the abutment portion 80 in a position to engage the hook portion 58 on the throttle actuator means 26 at an appropriate angular orientation of the actuator means 26, as indicated at FIG. *3c.* With the engagement of the hook portions 102 and 58, the throttle actuator 26 can be maintained in a position away from its rest position (i.e., maintained in a "fast idle" position). This third position, FIG. *3c,* therefore opens throttle for starting and permits a fast warm-up of a previously cold chain saw engine means without the necessity of continuous pressure against the actuator means 26 by the finger of the operator. Release from this fast idle position can be accomplished quite simply by the operator depressing the actuator 26 further (i.e., counter-clockwise rotation) than that shown in the position of FIG. *3c.* Such movement of the actuator 26 causes the hook portion 58 to disengage from the hook portion 102, thereby permitting the stop means 72 to rotate in a counter-clockwise direction under the influence of its biasing spring 84.

Since the operator's hand is gripping the hand grip means 20, the portion of the operator's hand overlying the slot 74 in the hand grip housing 30 will engage the edge 96 when the stop means 72 are in the position of FIG. 3*b*.

Another safety interlock system within the scope of the present invention is illustrated in FIGS. 4, 5, and 6*a*-6*c*, which are analogous, respectively to FIGS. 1, 2, and 3*a*-3*c*. The structure of this second illustrated safety interlock system is quite similar to that shown in FIGS. 1, 2, and 3*a*3*c*, so that similar numbers have been used to identify the analogous structurally elements. The description of FIGS. 4, 5, and 6*a*-6*c* need, therefore, focus only on the changed structures and relationships.

Figure 5:
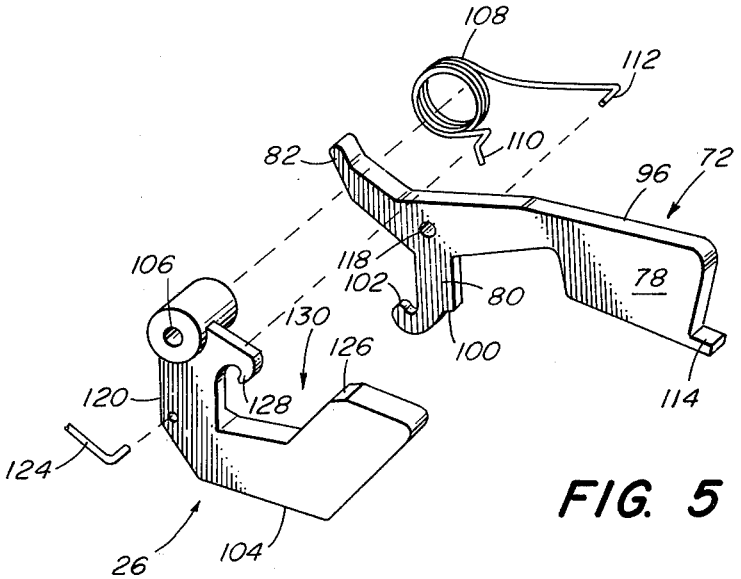

As best seen in FIG. 5, in this embodiment the actuator means 26 is generally planar, rather than ribbed, and includes a lower edge 104 disposed to be engaged by an operator's finger for rotating the actuator 26 about an axis 106 against the force of a biasing torsion spring 108. Opposite hooked ends 110 and 112 of the spring 108 engage portions of the actuator 26 and the stop means 72, respectively, so that a single biasing spring can bias these members counter-clockwise and clockwise, respectively toward their rest positions illustrated in FIG. 4. A projecting tab 114 of the stop means 72 is disposed to engage an internal rib 116 of the hand grip means to define the rest position of the stop means 72, with the edge 96 thereof exterior of the hand grip means in position to be engaged by a portion of an operator's hand. The member 72 is supported for pivotal motion about a pin 118 that is internally secured to portions of the housing 30. The rest position of the actuator 26 is defined by the engagement of a front edge 120 thereof with a rib 122 provided internally of the housing 30. An arm 124, secured to the actuator 26, forms part of a linkage between the actuator 26 and carburetor of the chain saw.

Figure 4:
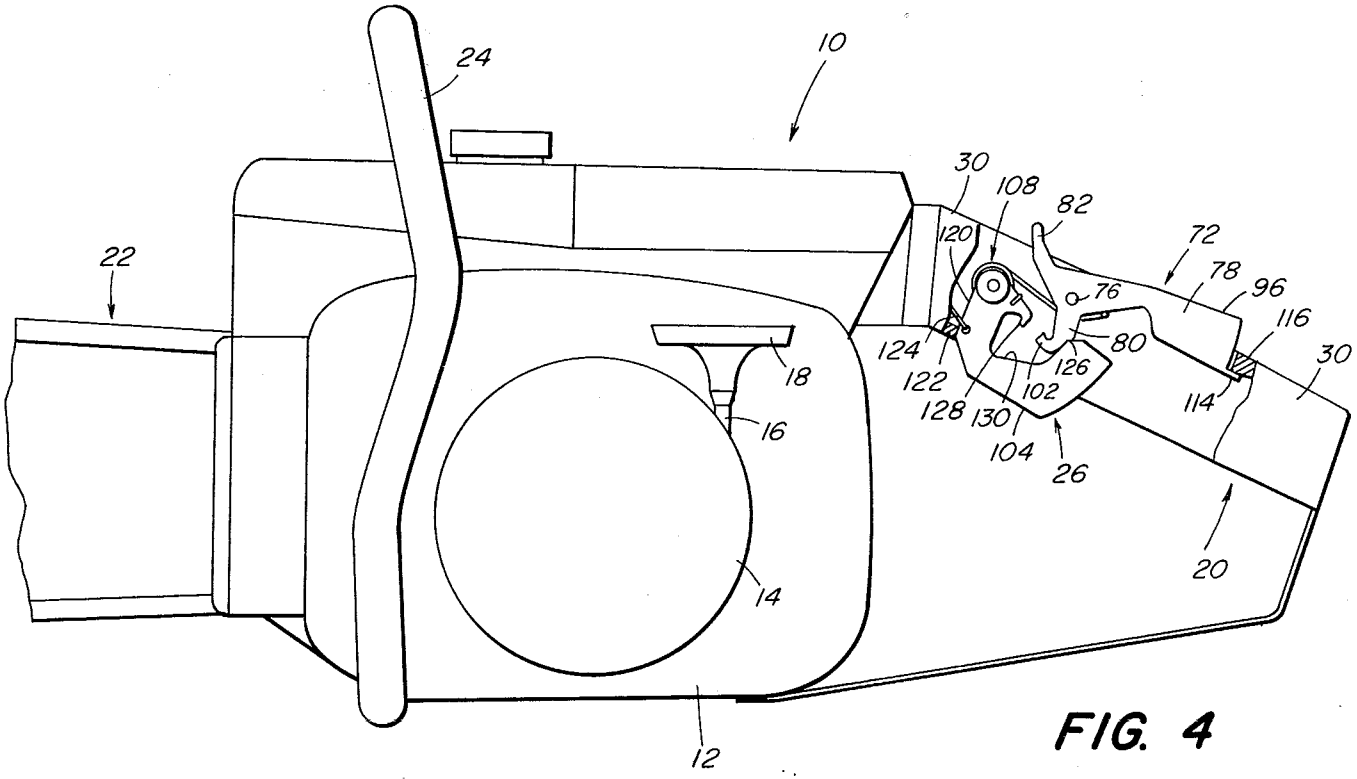

With the absence of ribs in the actuator 26 of the embodiment of FIGS. 4–5, a surface 126 for engagement with the abutment surface of the stop means 72 and a hook for engagement with the hook 102 of the stop means 72 are provided by edges adjacent a cut-out central portion 130 of the actuator 26. The cut-out 130 is sized and shaped to receive portions of the stop means abutment portion 80 in various positions of the stop means 72, thereby facilitating the compact arrangement of the means 26 and 72 and the engagement of hooks 102 and 128 for achieving the fast idle position of the actuator means 26. As will be apparent to those skilled in the art, the operation of the embodiment of FIGS. 4–5 is entirely analogous to the operation of the first described embodiment as discussed above in relation to FIGS. 3*a*-3*c*.

Figure 6A:
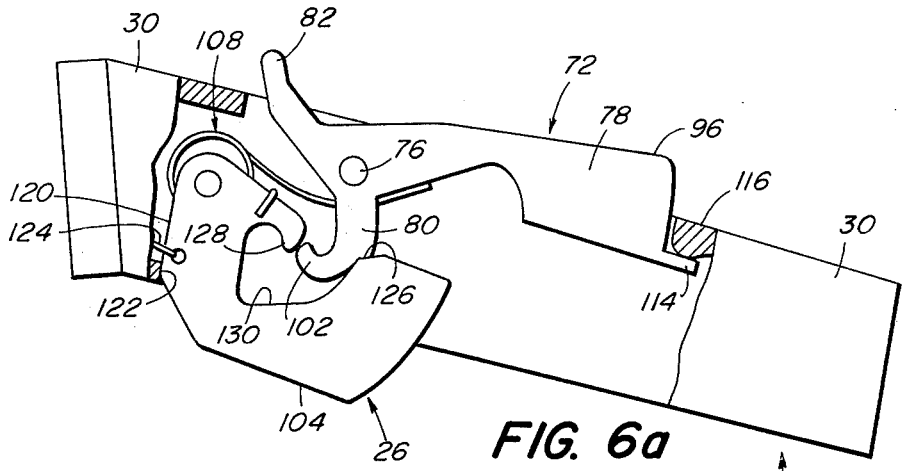
Figure 6B:
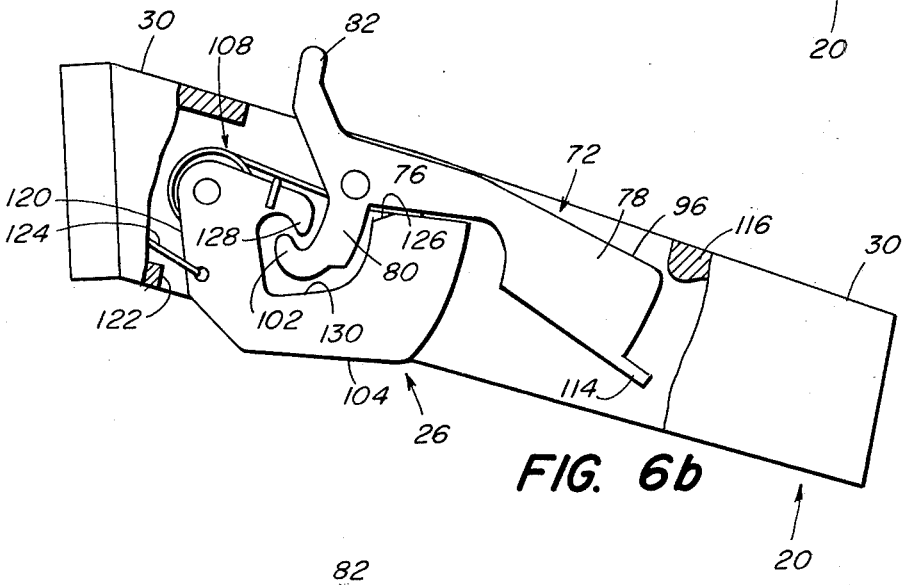
Figure 6C:
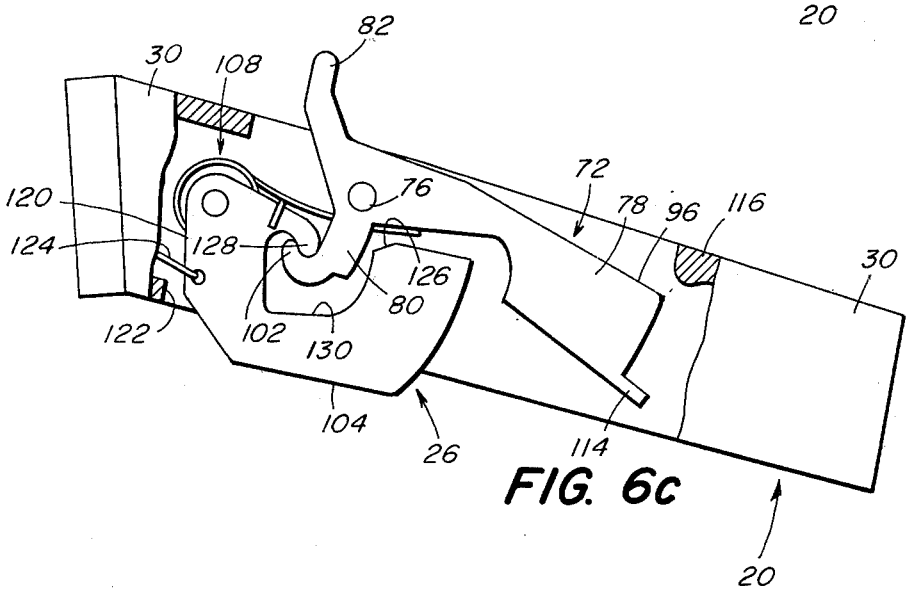

FIGS. 6*a*-6*c* are analogous to FIGS. 3*a*-3*c* and illustrate three operative positions of the stop member 72 and associated positions of the throttle actuator means 26. FIG. 6*a* shows the stop means 72 in the rest position under the influence of biasing spring 108. With the orientation, the stop means abutment surface 100 is positioned to intercept surface 126 on the throttle actuator 26, thereby preventing the throttle actuator 26 from being moved from that rest position. When the chain saw hand grip means 20 are properly gripped by an operator, however, the operator's hand will engage the edge 96 to cause clockwise rotation of the stop means 72 to the operating position indicated at FIG. 6*b*, thereby swinging the abutment portion 80 into the cut-out central portion 130 of the actuatur 126 to permit counter-clockwise rotation of the actuator 26. By employing the thumb lever portion 82, the operator of the chain saw can rotate the stop means 72 in a further clockwise direction to achieve the orientation shown in FIG. 6*c*. In that orientation, the hook portion 102 is disposed to engage the hook portion 128 of the actuator 26, thereby maintaining the actuator 26 in a "fast idle" position. As with the embodiment of FIGS. 1–3, release from this fast idle position can be accomplished by the operator depressing the actuator 26 further (i.e., counter-clockwise rotation) than that shown in the position of FIG. 6*c*, thereby causing the actuator hook portion 128 to disengage from the stop means of the portion 102 and permitting the stop means to rotate in a counter-clockwise direction under the influence of biasing spring 108.

SUMMARY OF THE ADVANTAGES AND SCOPE OF THE INVENTION

Thus, it may be seen that the present invention provides a safety interlock system for preventing accidental acceleration of a chain saw engine means. The interlock system includes a stop means for the chain saw throttle actuator means, including an abutment portion, and structure on the actuator means itself disposed to engage that abutment portion when the stop means is in a first position. Proper gripping of the chain saw hand grip by an operator's hand causes movement of the stop means from that first position and thereby permits free rotational movement of the throttle actuator means.

An additional advantage of such a safety interlock system is the provision of engageable hook portions on the stop means and the actuator means, arranged such that positioning of those two means by two digits of an operator's hand causes engagement of the hook portions and maintenance of the actuator means in a "fast idle" orientation.

Although the invention has been described with reference to particular embodiments, other additions, are not specifically described, will occur to those skilled in the art as well as modifications, substitutions, and deletions, all of which fall within the spirit and scope of the invention as defined by the following claims.

I claim:

1. In a chain saw including chain saw engine means;

chain saw cutter chain means;

chain saw drive means operable to provide a driving connection between said chain saw engine means and said chain saw cutter chain means;

chain saw hand grip means having spaced apart first and second exterior surfaces positioned to be engaged by an operator's hand gripping the hand grip means; and chain saw throttle actuator means positioned adjacent said first exterior surface to be engageable by a digit of an operator's hand gripping the hand means, said throttle actuator means biased toward a first, slow engine idle position and movable, in response to pressure from said operator's digit, to open-throttle positions;

the improvement comprising a safety interlock system for preventing movement of said throttle actuator means unless an operator's hand is properly gripping said chain saw grip means, said safety interlock system comprising a pivotally mounted stop member on said chain saw, and biasing means that bias the stop member toward a first position in which an abutment portion thereof prevents movement of the throttle actuators means from its first, slow engine idle position and in which a release portion of said stop member protrudes through an opening in said second exterior surface of said chain saw hand grip means; said stop member being movable, in response to pressure exerted on said release portion by an operator's hand gripping the chain saw hand grip means, to a second position in which said abutment portion is moved away from its first position to permit abutment of said throttle actuator in response to pressure applied by said digit of an operator and in which its abutment portion is closer to the pivot axis of the throttle actuator means than when the stop member is in its first position, thereby facilitating a compact arrangement of said throttle actuator means and said safety interlock system;

said stop member further including integral hook means for holding said throttle actuator means in a fast idle positon that is displaced from its first, slow engine idle position, said hook means being engagable with said throttle actuator means in a third position of said stop member, said stop member further including a lever portion that is accessible to the chain saw operator when the stop member is in its second position, thereby enabling an operator to move said stop member to its third position said lever portion is located with respect to said hand grip means so as to be movable by another digit of the operator's hand that grips the hand grip means, thereby enabling a single hand of the operator to cause engagement of said throttle actuator means with said hook means.

* * * * *

UNITED STATES PATENT AND TRADEMARK OFFICE

CERTIFICATE OF CORRECTION

PATENT NO. : 4,028,804

DATED : June 14, 1977

INVENTOR(S) : WALTER J. HAMMOND

It is certified that error appears in the above—identified patent and that said Letters Patent is hereby corrected as shown below:

Column 2, line 56, change "fromed" to --formed--;

Column 4, line 10, change "operator" to --operation--;

Column 5, line 42, after "hook" insert --128--;

Column 6, line 1, change "actuatur" to --actuator--, line 59, after "hand" second occurrence insert --grip--;

Column 7, line 4, change "actuators" to --actuator--, line 14, change "abutment" to --movement--.

Signed and Sealed this

*Sixteenth* Day of *October 1984*

[SEAL]

*Attest:*

GERALD J. MOSSINGHOFF

*Attesting Officer*

*Commissioner of Patents and Trademarks*